United States Patent [19]

Kuzia

[11] 4,416,250

[45] Nov. 22, 1983

[54] COMBUSTION APPARATUS AND REFRACTORY ELEMENTS FOR USE IN COMBUSTION APPARATUS

[76] Inventor: Stanley J. Kuzia, 610 Front St., Manchester, N.H. 03102

[21] Appl. No.: 297,432

[22] Filed: Aug. 28, 1981

[51] Int. Cl.[3] ..... F23M 5/00

[52] U.S. Cl. ..... 126/146; 126/151

[58] Field of Search ..... 126/146, 151, 144, 145, 126/148, 77, 73; 110/328

[56] References Cited

U.S. PATENT DOCUMENTS

| | | | |
|---|---|---|---|
| 128,296 | 6/1872 | Franklin | 126/146 |
| 1,133,200 | 3/1915 | Tipple | 126/151 |
| 2,367,094 | 1/1945 | Blumstengel | 126/151 |
| 2,370,644 | 3/1945 | Esson | 126/151 |
| 2,393,855 | 1/1946 | Cheasley | 126/151 |

*Primary Examiner*—James C. Yeung

*Attorney, Agent, or Firm*—Thomas N. Tarrant

[57] ABSTRACT

Refractory lining elements for stoves and furnaces containing vertical and intersecting lateral passages for aspirating burning fuel.

8 Claims, 4 Drawing Figures

COMBUSTION APPARATUS AND REFRACTORY ELEMENTS FOR USE IN COMBUSTION APPARATUS

BACKGROUND OF THE INVENTION

1. Field of the Invention

The present invention relates to refractory elements with self-contained air passages for combustion air and to heating apparatus using the elements.

2. Description of the Prior Art

It is common to use brick made of refractory materials to line stoves and provide dimensioned firepots. Such bricks have also been used to control the direction of airflow both to and from the combustion area. A recognized problem in burning fossil fuels is that usually a lot of the combustible material passes off through the flue as unburned gases. This reduces combustion efficiency and adds to pollution. Combustion apparatus today is designed to attempt to achieve a secondary burn in order to complete the combustion of what has formerly passed off as unburned gas. The problem is that most of this apparatus achieves the secondary burn only under optimum conditions and not under usual operating conditions. This is due to build up of ashes and addition of fresh fuel that interferes with proper aspiration and prevents the high temperatures necessary for the secondary burn.

SUMMARY OF THE INVENTION

In accordance with the invention, a method of aspirating combustion chambers and refractory lining elements therefore are provided. The lining material of the combustion chamber contains upward angled slots laterally traversing the lining material and intersecting with substantially vertical passages for carrying off volatile combustion by-products and assisting aspiration at multiple levels of the combustion chamber. The refractory elements are a lining material in various configurations to provide the slots and passages when assembled as linings in various types, shapes, and sizes of combustion chambers.

DESCRIPTION OF THE PREFERRED EMBODIMENT

Figure 1:
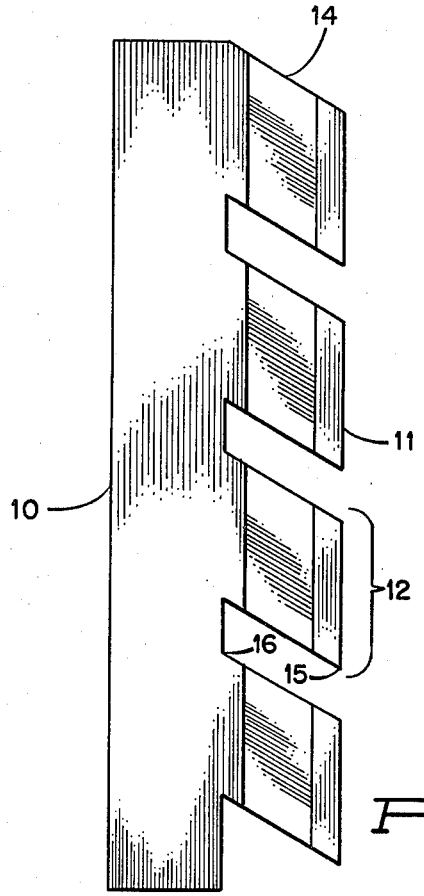
FIG. 1 is a side elevation of a firebrick element according to the invention.

A refractory element according to the invention is depicted in FIG. 1. The element as depicted in FIG. 1 has been made of refractory brick but can also be made in the form of a metal casting or other material of an ability to withstand the heats encountered in the particular combustion apparatus.

FIG. 1 is a side view of a refractory element 10 in which surface 11 would be facing the combustion chamber. Surface 11 is interupted by a series of upwardly angled slots 12. Slots 12 extend inwardly to about ½ the thickness of element 10 and angle in an upward direction as they extend in. Slots 12 extend continuously across face 11 and each slot 12 has an opening height that is preferably determined by the type of fuel being burned. Thus, if the combustion fuel is coal, slots 12 have a height that is less than the diameter of most of the coal chunks that would be used. Slots 12 can take up anywhere from about 1/10 to ½ of the surface area of surface 11, thus the number of slots will be greater with narrower slots than with wide slots. With a smaller number of wider slots the element becomes less fragile but the slots become more susceptible to blockage by combustion material and the continuity of even combustion is not as smooth, as will be described below.

Slots 12 are intersected by vertical passages 14 extending vertically through the slotted portion of element 10. While not critical, the angling of slots 12 has been made such that the edge 15 of surface 11 above a slot opening lies on a horizontal with or slightly below the lower inner corner 16 of the slot. The degree of angle is selected to optimize air flow and minimize blocking and filling of the slots with combustion materials. One suitable refractory lining element in the configuration of that depicted in FIG. 1 has been made with a height of thirteen inches, a width of five and one half inches and a thickness of three and one half inches. Slots 12 were made with a height of three quarter inches and a depth of one and three quarter inches angled at thirty (30°) degrees. Vertical passage 14 was formed as a semi-cylindrical passage one in each side of element 10 and having a diameter of one and two tenths inches. Vertical passage 14 was formed in such a way that with elements 10 positioned adjacent to each other side-by-side, two passages 14 join to form a hollow cylinder.

Figure 2:
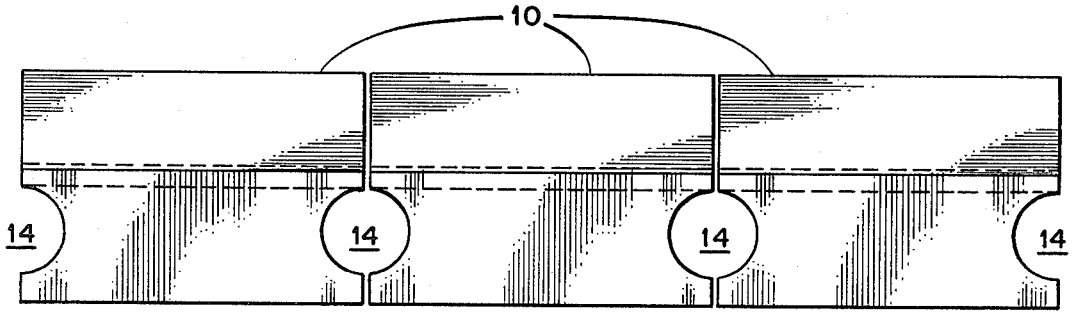
FIG. 2 is a top plan view of firebrick elements according to FIG. 1 placed side by side.

FIG. 2 depicts 3 elements 10 adjoining each other side by side in a top plan view. Thus FIG. 2 shows how semi-cylindrical passages 14 join to produce a passage in the form of a hollow cylinder.

Figure 3:
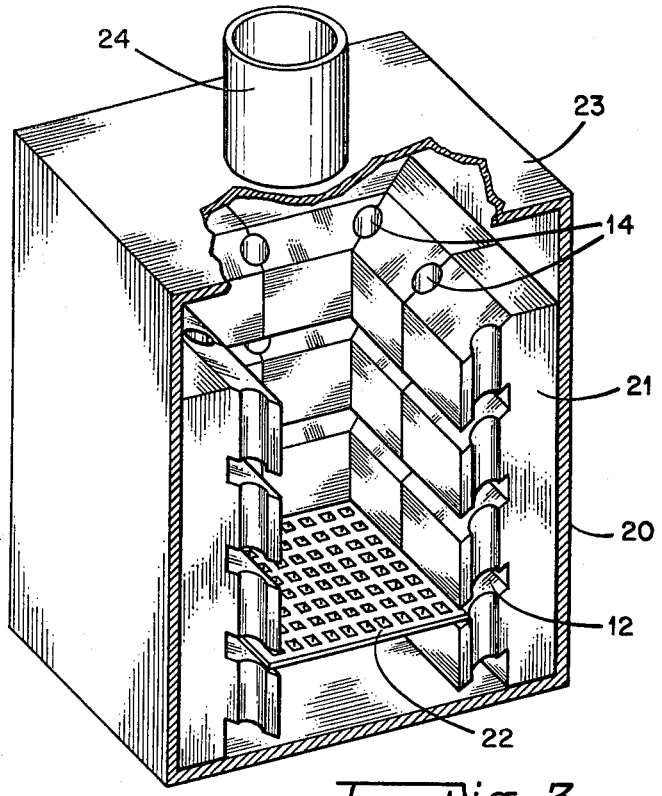
FIG. 3 is an isometric projection of a stove lined with firebrick elements according to the invention with front removed.

Referring now to FIG. 3, combustion apparatus is depicted in the form of stove 20 having its front removed to show refractory lining elements 21 and grating 22. Stove 20 has a metal housing 23 shown in section with a flue 24 connected through the top. At least one of slots 12 is disposed below grating 22 for passage of ambient air entering from outside the stove. Elements 21 may be one or more elements stacked in height and terminating above the combustion zone. Burned gases leaving the combustion zone pass either directly upward from the combusting material or through slots 12 and passages 14 to reach flue 24. Flue 24 would connect to a suitable chimney.

Operation of combustion apparatus as depicted in FIG. 3 is possible at a highly efficient level even with combustion material filling the apparatus well above the grate to or nearly to the top of elements 21. Combustion is commenced at the grating level. In this level combustion air enters underneath the grating and feeds the combustion immediately above the grating. The burned gases pass upward through the nearest level of slots 12. While some of these combustion gases may feed up through the combustible material, the combustible material itself impedes flow so that the greater part passes through slots 12. Fresh air entering through the slot or slots 12 below grating 22 mix with the combustion gases at the higher slot level and promote further burning. As combustion continues upward through the layers of combustible material, the combustion gases pass out through successively higher levels of slots 12. Additionally the draft produced by rising heated gases pulls additional air in through the lower slot 12 below grating 22 and in through the slot or slots immediately below the combustion zone to feed the combustion with fresh air bypassing the ashes beneath the combustion zone. Again a portion of this air mixes with the gases at a higher level to complete combustion of the combustion gases passing upward through passages 14 to flue 24. Thus combustion apparatus utilizing refractory lining elements in accordance with the invention provide a greater uniformity and efficiency of burning.

The refractory lining elements of the invention also serve an additional function in that they conduct the combustion heat more quickly to the walls of the combustion apparatus in a uniform distribution. This in turn provides more efficient heat exchange to the surrounding ambient air or other heat exchange medium with less heat losses through the flue. Thus the refractory lining elements of the inventon serve a useful function even with combustion apparatus utilizing gaseous or liquid fuels.

Figure 4:
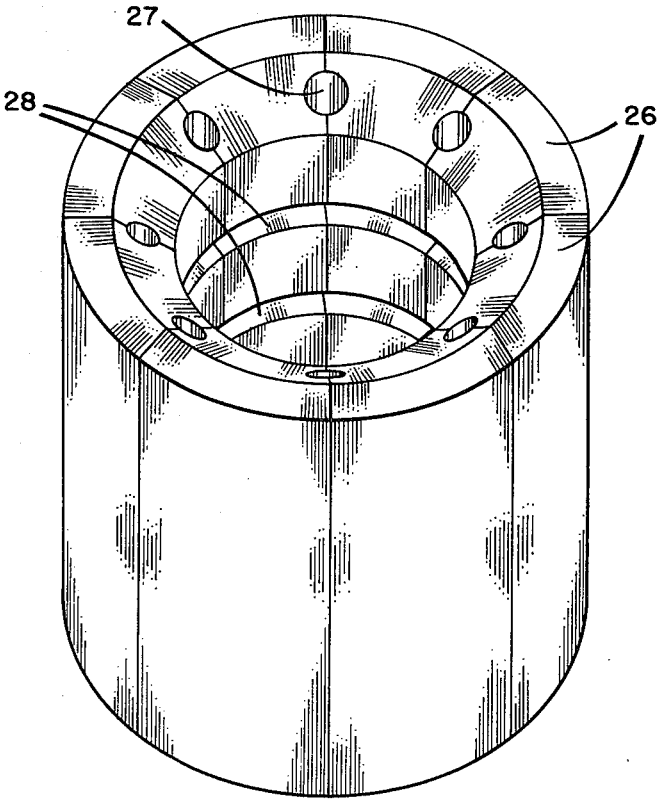
FIG. 4 is an isometric projection of a cylindrical firepot made with firebrick elements according to the invention.

While the apparatus described utilizes generally rectangular refractory lining elements, other shapes are used to fit particular applications. For example, a lot of firepots are cylindrical and refractory lining elements 26 as depicted in FIG. 4 can be made in an arcuate shape whereby they may be fitted together to produce a cylindrical firepot. Vertical aspirating passages 27 are similar to passages 14 of FIG. 1 and slots 28 are likewise similar to those shown in FIG. 1 although following the arcuate shape of element 26.

While the invention has been described relative to specific embodiments a number of variations are contemplated. For example, a small firepot in the general configuration of FIG. 4 could be made by casting the lining in two identical halves. Additional vertical passages would be cast in between the edges of each element. Other shapes can be used for the elements and the elements can be made stacked with only one slot for each unit and the space and heights of the slots can be varied for benefits in particular applications. Thus the slots could be relatively widely separated near the bottom with graduations making them closer together toward the top of the combustion chamber. Accordingly, it is intended to cover the invention as set forth in the following claims.

I claim:

1. A refractory casting configuration for use in lining firepots of stoves and furnaces comprising:

(a) an upright element of refractory material having an outside face, an inside face, a first side, a second side, a bottom end and a top end;

(b) at least one slot extending entirely across said inside face angling toward said top end as it extends toward said outside face;

(c) a recess in each of said first side and said second side extending from said bottom end to said top end and intersecting each of said at least one slot, whereby when a plurality of said elements are placed in side-by-side contact, said at least one slot in each element becomes continuous with said at least one slot in each of said plurality, and each of said recess mates with a corresponding recess in an adjacent block to form a vertical flue passage.

2. A refractory casting according to claim 1 made from refractory brick and wherein said at least one slot is a plurality of slots.

3. A refractory casting according to claim 1 wherein said recess is shaped to form a hollow cylinder when said element is joined in side-by-side relationship with a second identical element.

4. A refractory casting according to claim 1 wherein said at least one slot extends to a depth of at least half the thickness of said element.

5. A refractory casting according to claim 4 wherein said slot is angled so that the opening of said slot is entirely below the inside terminating wall of said slot.

6. Combustion apparatus comprising:

(a) a combustion chamber housing;

(b) a flue connection to said housing;

(c) a plurality of refractory lining elements positioned against the inner walls of said housing to enclose a combustion zone, each of said lining elements having at least one slot extending horizontally completely across a face of said element facing said combustion zone and in line with the corresponding slot of each adjacent element to provide continuous slots being all adjoining elements, said slot angling toward the top of and terminating in the element as it extends into the thickness of the element; and (d) periodically spaced vertical passages contained within said lining elements, said vertical passages being relatively narrow compared to the width of each said slot and intersecting said at least one slot in each of said lining elements.

7. Combustion apparatus comprising:

(a) a combustion chamber housing;

(b) a flue connection to said housing;

(c) a plurality of refractory lining elements positioned against the inner walls of said housing to enclose a conbustion zone, each of said lining elements having a plurality of slots extending horizontally completely across a face of said element facing said combustion zone, said slots angling toward the top of and terminating in the element as they extend into the thickness of the element, each of said plurality of slots being intersected by a vertical passage that is narrow relative to the width of said slots whereby each said slot acts as a baffled burning chamber for secondary burn of volatile gasses before expansion into said vertical passage.

8. Combustion apparatus according to claim 7 further comprising a grating supported in said housing for retaining combustion material and wherein at least one level of said slots opens below said grating for access of ambient air.

* * * * *